United States Patent [19]

Marchesi

[11] 4,004,128

[45] Jan. 18, 1977

[54] PORTABLE ELECTRIC RADIANT HEATER

[76] Inventor: Carlo Marchesi, 31 Winter St., Saugus, Mass. 01906

[22] Filed: Apr. 18, 1975

[21] Appl. No.: 569,485

[52] U.S. Cl. ..... 219/346; 126/91 A; 165/181; 219/341; 219/342; 219/358; 219/530; 338/236

[51] Int. Cl.[2] ..... H05B 1/02; H05B 3/44; F24H 9/18; F28F 1/20

[58] Field of Search ..... 219/339, 340, 341, 342, 219/344, 350–358, 377, 530, 540, 544, 534; 126/248, 91; 338/234–237, 214, 283, 293; 165/181

[56] References Cited

UNITED STATES PATENTS

| | | | |
|---|---|---|---|
| 598,639 | 2/1898 | McElroy | 219/353 X |
| 998,269 | 7/1911 | Trepreau | 219/342 UX |
| 1,386,356 | 8/1921 | Pasik | 219/342 X |
| 1,475,162 | 11/1923 | Abbott | 219/540 |
| 1,543,721 | 6/1925 | Procter | 219/352 |
| 1,548,305 | 8/1925 | Dalton | 219/342 UX |
| 2,566,318 | 9/1951 | Dalin et al. | 165/181 X |
| 2,723,338 | 11/1955 | Antoni | 219/352 X |
| 2,852,657 | 9/1958 | Markel et al. | 219/358 X |
| 3,140,387 | 7/1964 | Green | 219/346 |
| 3,678,919 | 7/1972 | Marchesi | 126/248 X |

FOREIGN PATENTS OR APPLICATIONS

| | | | |
|---|---|---|---|
| 354,784 | 12/1937 | Italy | 219/350 |

*Primary Examiner*—A. Bartis
*Attorney, Agent, or Firm*—Harvey B. Jacobson

[57] ABSTRACT

A portable electric radiant heater comprises an insulative housing having a control area and an open front heating area. A hollow fired clay pipe system is disposed in the heating area in serpentine fashion and arranged to radiate heat through the open front. The clay pipe system comprises a plurality of hollow cylindrical pipe segments having a plurality of hollow protuberances extending therefrom. The pipe segments are interconnected together to form a continuous passage extending the length of the pipe system. An electric resistance heating wire extends centrally through the continuous passage in spaced relation to the surfaces defining the passage. The ends of the wire extend into the control area and are connected to a power supply means therein controlled by a thermostatic control having a sensing element enclosed in a clay cylinder disposed in heating area below the heat radiating pipe system.

11 Claims, 4 Drawing Figures

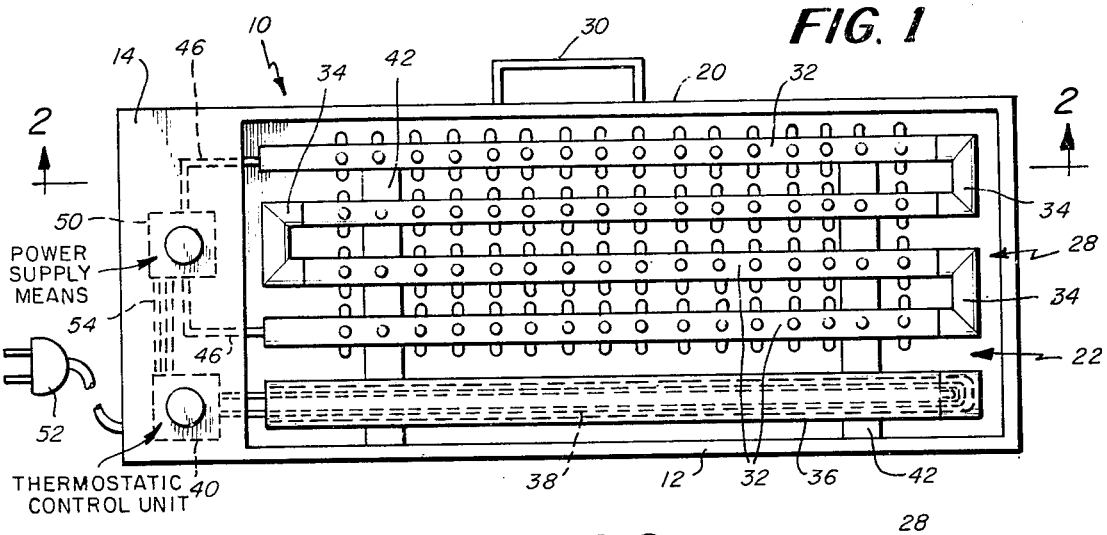
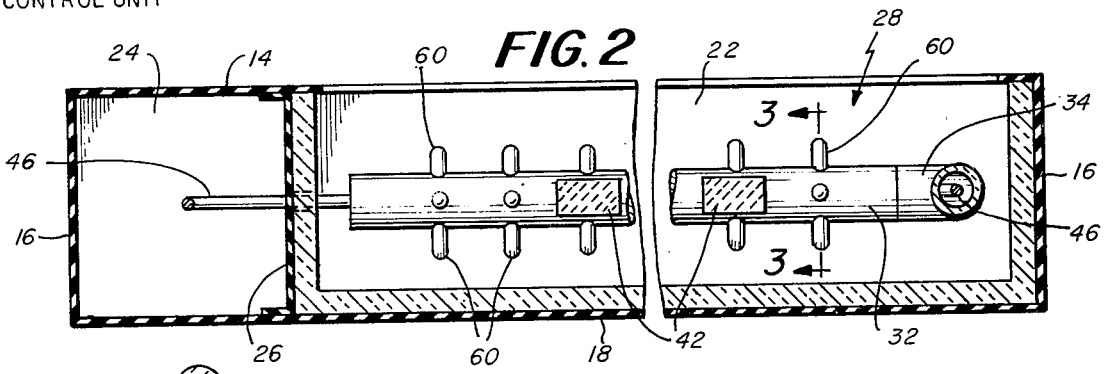
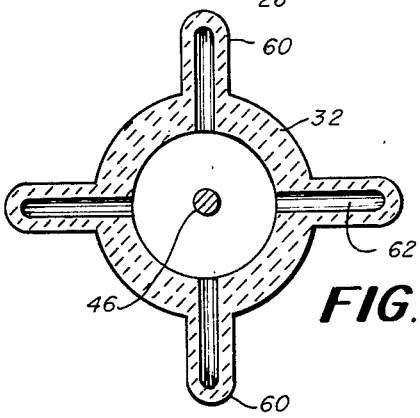
FIG. 3
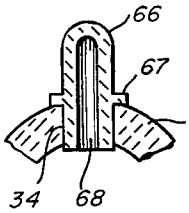
FIG. 4

PORTABLE ELECTRIC RADIANT HEATER

BACKGROUND OF THE INVENTION

The present invention relates, generally, to area heaters, and more particularly concerned with a heater wherein the heater need be used only for relatively short periods of time with the heater itself storing the heat and effecting a radiation of the heat over extended periods of time.

My U.S. Pat. No. 3,678,919 shows a clay area heater, which provides adequate and effective heating for a predetermined area. However, there are some drawbacks associated with this arrangement. For example, it does take some time before the heat generated by the heating unit can be absorbed by the upper heat section.

Accordingly, it is an object of the present invention to provide an improved electric heater which is an improvement over the heater shown in my U.S. Pat. No. 3,678,919.

Another object of the present invention is to provide a heater which is both of simple and economical construction and yet provides substantial heating capability.

A further object of the present invention is to provide a heater which is substantially maintenance free and economical to operate.

A further object of the present invention is to provide a heater preferably constructed of clay pipe segments wherein these segments are very rapidly heated and radiate heat over a relatively long time period.

SUMMARY OF THE INVENTION

To accomplish the foregoing and other objects of this invention, the heater comprises a housing that is generally partitioned into a heating area and a control area, and a continuous pipe system which is disposed in the heating area and comprises a plurality of hollow pipe segments each constructed of clay or a ceramic material that quickly absorbs heat and radiates the heat over a relatively longer time period. Each of the hollow pipe segments, which may be in the form of a cylinder, has a plurality of protruberances extending therefrom which may be integrally formed with the pipe segment. Alternatively, the protruberances may be removable and generally extend radially outwardly of the cylindrical pipe segment. A conductor means which may be in the form of a "nichrome" heater wire extends through the pipe system and connects to a power source which can be operated to heat the wire. The heat thus generated is stored in the pipe system from where it is radiated from the heater over a relatively prolonged time period in comparison to the time that it takes to heat the pipe system. The power source may be thermostatically controlled and there may be included a temperature sensing tube. The thermostat output couples to the power source for controlling the operation thereof.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a front view of the device of this invention;

FIG. 2 is a cross sectional view taken along line 2—2 of FIG. 1;

FIG. 3 is a cross sectional view taken along line 3—3 of FIG. 2; and

FIG. 4 is a cross sectional view like that shown in FIG. 3 for an alternate embodiment.

DETAILED DESCRIPTION

Referring now more specifically to the drawings, there is shown a housing 10 comprising a plurality of enclosing walls including a base 12, front wall 14, side walls 16, back wall 18, and top 20, all of which may be constructed of an insulating material such as a "bakelite" material. The inner surface of the walls of housing 10 may be lined with an insulating material as shown in FIG. 2 on walls 16, 18 and 26. The housing 10 is basically separated into a heating area 22 and a control area 24 by means of a vertical partition wall 26 which is shown in FIG. 2. The front wall 14 defines a rectangular opening 28 which may be covered by a screen or the like not shown in the drawings and which could be fabricated of clay. The top may have a handle 30 suitably secured thereto for permitting easy carrying of the heater.

A continuous pipe system is contained within the heating area 22 and comprises a plurality of clay cylinders 32 with adjacent cylinders interconnected by a coupling joint 34 which may also be constructed of clay. The coupling joints 34 may be dimensioned to slide into the cylinders 32 to form a continuous pipe system as clearly depicted in FIG. 1. FIG. 1 also shows a bottom cylinder 36 which is also constructed of clay and has contained therein a heat sensing wire 38 which couples to the thermostat control 40. Thermostat control 40 is of conventional type and may be any one of many different commercially available units. The thermostat control 40 is responsive to the temperature sensed by heat sensing wire 38 and has means for activating and de-activating power supply means 50 in response to the temperature sensed by wire 38. The pipe system including the cylinder 36 is supported by clay blocks 42 which may be square blocks having opposite concavities for fitting with the cylinders 32. These blocks are preferably glued to the cylinders and are constructed of clay. These blocks support the entire pipe system in a fixed relationship within the heating area 22. These blocks 42 may be constructed of layers of clay fastened with a heat resistant glue with each block also being glued between the cylinders as shown in FIG. 1.

The heating of the cylinders is accomplished by using a conductor wire 46 which is continuous and extends through the pipe system and into the control area 24 where it connects to a power supply means 50. FIG. 1 also shows the typical AC plug 52 which couples to the power supply means 50. The power supply means 50 may supply AC or a DC and includes input lines 54 coupled from the thermostat 40 for energizing and de-energizing the power supply means 50. The conductor wire 46 may be a "nichrome" heater wire or any other suitable alloy band which extends uninterrupted through the pipe system. When the energy is applied to this conductor means heat is generated which is conveyed to the clay cylinders 32 where the heat is stored and slowly released after the heat source has been de-activated.

The cylinders 32 as particularly noted in FIGS. 2 and 3, have a plurality of protruberances 60 extending therefrom. These protruberances are integrally formed with the cylinder 32 and each define a hollow channel 62. The protruberances are disposed in sets of four and are disposed at 90° angles about the cylinder 32. The use of these protruberances enhance the heat radiation and at the same time tend to slow down the overall radiation from the cylinder 32 by establishing vortexes of warm air which encircle the tope of the protrusions.

FIG. 4 shows a slightly different embodiment. In FIG. 4 there is shown the cylinder 32 having an aperture 34 for fitting a removable protrusion element 66 having a flange 67 that limits the position of the member 66 within the cylinder 32. These members 66 can easily be slid into the apertures 34 and also have a hollow channel 68 extending therethrough as indicated in FIG. 4.

It is preferred that the cylinders 32 be constructed of clay such as, for example, red clay or kaolin, the clay in each instance preferably being baked or fired twice so as to achieve a high degree of hardness and durability.

Because clay is relatively inexpensive, the device of the present invention can be constructed rather economically. Also, the particular construction of the device adapts it for highly efficient operation wherein the power source need be activated for only relatively short periods of time. The efficiency of the heater arises in part from the construction of the heater in a manner whereby the heat can be rapidly stored and subsequently slowly radiated, thus necessitating the actual energization of the power source for only short periods of time. Ths use of clay as the material of the heater is also considered to contribute significantly both to the economical nature of the unit and to the ability of the unit to perform as desired. The compact nature of the heater enables one to move the heater as desired, requiring only the presence of a source of electricity thus further enhancing the economic feasability of the heater.

Another important feature of this improved heater is the provision of the close proximity of the heating conductor to the heat retaining cylinders. The heat is immediately conveyed inside the cylinders to the clay structure and yet dissipates from the structure relatively slowly.

The foregoing is considered as illustrative only of the principles of the invention. Further, since numerous modifications and changes will readily occur to those skilled in the art, it is not desired to limit the invention to the exact construction or operation shown and described and accordingly all suitable modifications and equivalence may be resorted to, falling within the scope of the invention.

What is claimed is:

1. A heater comprising;

a housing having means defining a heating area in the housing and a control area in the housing, said heating area of the housing having an open front, a hollow pipe system disposed in the heating area of the housing and arranged to radiate heat through said open front, said pipe system comprising a plurality of pipe segments each constructed of a fired clay material that rapidly absorbs heat and radiates the heat over a long time period and a plurality of protruberances radially extending from each pipe segment, means coupling said hollow pipe segments together to form a continuous internal passage, an electrical resistance heating conductor means extending through the continuous passage in the pipe system in spaced relation to the inner surface thereof and with the ends of the conductor means extending into the control area of the housing, said conductor means being disposed in each pipe segments with essentially only an air space between the inner surface of the pipe segments and conductor means, and an electric power supply means disposed in the control area and coupled to the ends of the conductor means, said power supply means being selectively operated to energize the conductor means to thereby heat said hollow pipe system for radiating heat through said open front.

2. A heater as set forth in claim 1 having a top wall and a handle secured to said top wall of the housing for facilitating carrying of the heater.

3. A heater as set forth in claim 1 wherein said power supply means supplies AC and includes an input control line, and means coupled to said control line for controlling the operation of the power supply means.

4. A heater as set forth in claim 3 said means coupled to said control line includes temperature responsive means having a thermostatic control unit disposed in the control area and whose output is coupled to the control line of the power supply means and a temperature sensing conductor means disposed in the heating area and coupled to the thermostatic control unit.

5. A heater as set forth in claim 4 including a filed clay cylinder for housing the temperature sensing conductor means disposed adjacent to the pipe system at the bottom of the housing.

6. A heater as set forth in claim 5 wherein said protruberances are disposed in sets, each set disposed at a predetermined location along said pipe segment and all said protruberances being at least partially hollow and integrally formed with the pipe segment, said protruberances having an internal passage communicating with the hollow area of the pipe segment.

7. A heater as set forth in claim 1 wherein said protruberances are grouped in sets that are disposed at spaced intervals along the pipe segment.

8. A heater as set forth in claim 7 wherein the protruberances are hollow and have a hollow channel communicating with the hollow inside of the pipe segment.

9. A heater as set forth in claim 8 wherein the protruberances of each set are disposed radially at 90° intervals.

10. A heater comprising;

a housing defined by side walls, a front wall, a back wall, a bottom and a top, and including a partitioning wall separating the housing into a heating area and a control area, the heating area being open at the front, a hollow fired clay pipe system disposed in the heating area and extending in a serpentine fashion, said system comprising a plurality of hollow pipe segments each constructed of fired clay, coupling joints interconnecting the pipe segments to form a continuous passage and maintaining the pipe segments in parallel to each other, means for supporting the pipe system in the heating area of the housing for radiating heat through the open front of the heating area, and a plurality of sets of clay protruberances on said pipe segments, said sets being spaced along each pipe segment and all said protruberances being at least partially hollow having an internal passage communicating with the hollow area of the pipe segment, a heat radiating electric resistance heating wire extending through the continuous passage in the pipe system, said wire being disposed centrally in each pipe segment in spaced relation to the inner surface thereof with essentially only an air space between the wire and pipe segment, the ends of said wire also extending through said partitioning wall to the control area of the housing, a separate hollow fired clay cylinder disposed in the heating area of the housing adjacent the hollow pipe system, a temperature sensing conductor means disposed in the heating area extending in a loop inside of the hollow clay cylinder and extending through the partitioning wall to the control area of the housing, and control means disposed in the control area of the housing and including a thermostat unit coupled to the temperature sensing conductor means responsive to the temperature sensed thereby and electrical power supply means responsive to the thermostat unit and coupled to the heat radiating heating wire for selectively sending current to the heat radiating wire in response to demands from the thermostat unit whereby the hollow pipe system is selectively heated for radiation through said open front.

11. A heater as set forth in claim 10 wherein the protruberances have a cylindrical shape with an arcuate terminating end, and include a flange for removably seating the protruberance in a hole in the pipe segment and where each set comprises four protruberances radially disposed at 90° intervals about the pipe segment.

* * * * *